US010526831B2

(12) United States Patent
Haworth

(10) Patent No.: US 10,526,831 B2
(45) Date of Patent: Jan. 7, 2020

(54) DOOR AND SUSPENSION MECHANISM ASSEMBLY AND AN ASSEMBLY OF AN ELONGATED HOUSING AND A DOOR AND SUSPENSION MECHANISM ASSEMBLY

(71) Applicant: Huawei Technologies Co., Ltd., Shenzhen (CN)

(72) Inventor: Stephen Haworth, Kista (SE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 134 days.

(21) Appl. No.: 15/687,158

(22) Filed: Aug. 25, 2017

(65) Prior Publication Data

US 2017/0350177 A1 Dec. 7, 2017

Related U.S. Application Data

(63) Continuation of application No. PCT/EP2015/054017, filed on Feb. 26, 2015.

(51) Int. Cl.

| | |
|---|---|
| ***E05D 15/58*** | (2006.01) |
| ***E05D 3/02*** | (2006.01) |
| ***E05F 1/14*** | (2006.01) |
| ***E06B 7/22*** | (2006.01) |
| ***E06B 7/28*** | (2006.01) |

(52) U.S. Cl.

CPC ..... *E05D 15/581* (2013.01); *E05D 3/022* (2013.01); *E05F 1/14* (2013.01); *E06B 7/22* (2013.01); *E06B 7/28* (2013.01); *E05D 2015/586* (2013.01); *E05Y 2900/602* (2013.01)

(58) Field of Classification Search

CPC . E05D 3/022; E05D 15/581; E05D 2015/586; E05C 17/02

See application file for complete search history.

(56) References Cited

U.S. PATENT DOCUMENTS 3,768,203 A * 10/1973 Bellucci ..... E05D 3/06 49/254
4,709,972 A * 12/1987 LaBudde ..... A47B 21/007 312/208.3
4,932,160 A * 6/1990 Sperko ..... B01J 3/03 49/254

(Continued)

FOREIGN PATENT DOCUMENTS

CN 101077288 A 11/2007
CN 104033052 A 9/2014

(Continued)

OTHER PUBLICATIONS

Machine Translation and Abstract of Chinese Publication No. CN104033052, Sep. 10, 2014, 6 pages.

(Continued)

*Primary Examiner* — Catherine A Kelly
(74) *Attorney, Agent, or Firm* — Conley Rose, P.C.

(57) ABSTRACT

A door and suspension mechanism assembly for use at or near an end of an elongated housing, where the suspension mechanism allows a linear movement of the door relative to the elongated housing and for a pivoting movement of the door relative to the elongated housing. Hence, the door and the suspension mechanism assembly provide access to a cavity in the elongated housing.

16 Claims, 5 Drawing Sheets

(56) References Cited

U.S. PATENT DOCUMENTS

| | | | | |
|---|---|---|---|---|
| 5,297,840 | A * | 3/1994 | Size | B60P 1/4464 292/300 |
| 6,125,508 | A * | 10/2000 | Formenti | E05D 5/08 16/278 |
| 6,318,824 | B1 * | 11/2001 | LaGrotta | E05D 3/022 312/322 |
| 7,068,208 | B2 * | 6/2006 | Wu | E05D 15/58 312/218 |
| 7,093,733 | B2 * | 8/2006 | Nishimura | B01J 3/03 220/236 |
| 7,891,747 | B2 * | 2/2011 | Hahn | A47F 3/005 312/139.1 |
| 7,975,433 | B2 * | 7/2011 | Dunstan | E05D 3/06 109/74 |
| 8,215,729 | B2 * | 7/2012 | Hunnell | D06F 39/12 312/228 |
| 8,430,260 | B2 * | 4/2013 | Guidry, Jr. | B01J 3/03 220/212 |
| 9,332,842 | B2 * | 5/2016 | Herron | A47B 96/00 |
| 9,624,705 | B2 * | 4/2017 | Haab | E05D 3/04 |
| 9,673,599 | B2 * | 6/2017 | Ketterer | H05K 5/0226 |
| 2002/0140327 | A1 * | 10/2002 | Kim | E05B 65/46 312/311 |
| 2009/0308863 | A1 * | 12/2009 | Naumann | H02G 3/14 220/3.7 |
| 2010/0043174 | A1 * | 2/2010 | Bestle | G06F 1/1616 16/303 |
| 2012/0047686 | A1 * | 3/2012 | Hautamaki | G06F 1/1616 16/366 |
| 2012/0153790 | A1 * | 6/2012 | Hammer | E06B 5/18 312/322 |
| 2013/0257238 | A1 | 10/2013 | Herron et al. | |
| 2015/0167367 | A1 * | 6/2015 | Sawaguchi | E05D 3/022 49/398 |
| 2018/0119471 | A1 * | 5/2018 | Iacovoni | E05F 15/603 |

FOREIGN PATENT DOCUMENTS

| | | | |
|---|---|---|---|
| CN | 104204185 | A | 12/2014 |
| DE | 20109557 | U1 | 9/2001 |
| EP | 1439277 | A1 | 7/2004 |
| EP | 1860263 | A2 | 11/2007 |
| EP | 1860263 | B1 | 10/2010 |
| EP | 2351898 | A1 | 8/2011 |
| FR | 2814321 | A3 | 3/2002 |

OTHER PUBLICATIONS

Foreign Communication From a Counterpart Application, Chinese Application No. 201580074521.4, Chinese Office Action dated Feb. 6, 2018, 9 pages.

Machine Translation and Abstract of German Publication No. DE20109557, Part 1, Sep. 27, 2001, 10 pages.

Machine Translation and Abstract of German Publication No. DE20109557, Part 2, Sep. 27, 2001, 6 pages.

Machine Translation and Abstract of European Publication No. EP2351898, Aug. 3, 2011, 13 pages.

Machine Translation and Abstract of French Publication No. FR2814321, Mar. 22, 2002, 9 pages.

Foreign Communication From a Counterpart Application, PCT Application No. PCT/EP2015/054017, English Translation of International Search Report dated Nov. 5, 2015, 6 pages.

Foreign Communication From a Counterpart Application, PCT Application No. PCT/EP2015/054017, English Translation of Written Opinion dated Nov. 5, 2015, 6 pages.

Machine Translation and Abstract of European Publication No. EP1439277, dated Jul. 21, 2004, 11 pages.

Foreign Communication From A Counterpart Application, Chinese Application No. 15709862.5, European Office Action dated Oct. 28, 2019, 5 pages.

* cited by examiner

Fig. 4
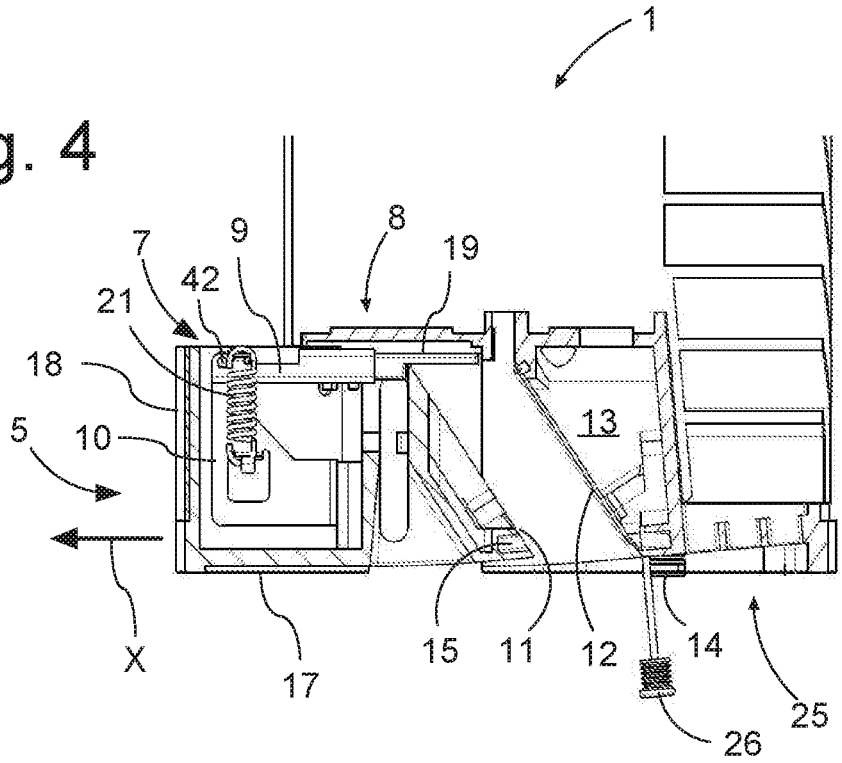
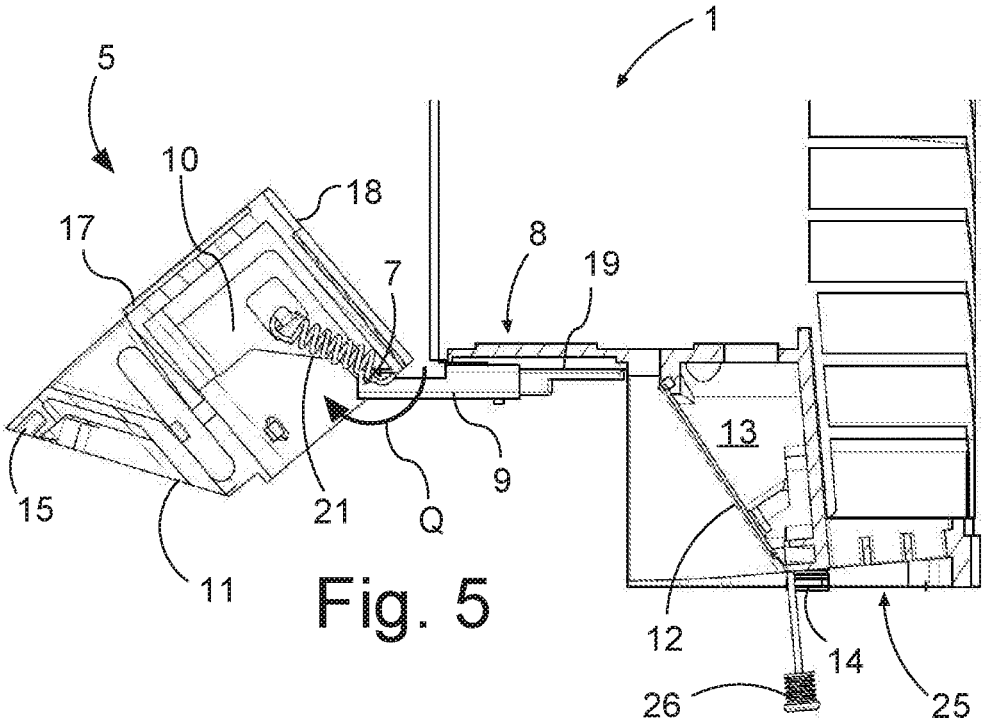
Fig. 5

DOOR AND SUSPENSION MECHANISM ASSEMBLY AND AN ASSEMBLY OF AN ELONGATED HOUSING AND A DOOR AND SUSPENSION MECHANISM ASSEMBLY

CROSS-REFERENCE TO RELATED APPLICATIONS

This application is a continuation of International Patent Application No. PCT/EP2015/054017 filed on Feb. 26, 2015, which is hereby incorporated by reference in its entirety.

TECHNICAL FIELD

The disclosure relates to a door for providing access to a cavity in a housing, such as an antenna housing or a remote radio unit (RRU) housing.

BACKGROUND

Existing antenna units and RRUs provide a performance improvement in terms of signal integrity and energy consumption when they are in close proximity with each other or coupled together in a single integrated product. To make the integrated solution less obtrusive it is desirable to install the units as close to the mast or wall on which they are mounted as possible which then presents a challenge for cabling and cooling of the unit. Traditionally rectangular shapes have been used for the elongated housing of the RRU and antenna unit. A more recent development are RRUs and antenna units with a cylindrical housing, which is less visually impactive on the environment, provides a good shape to reduce wind load, can be mounted close to 25 millimeters (mm) on a support structure such as a pole which also reduces the forces on the mounting bracket due to a small turning moment. The cylindrical shape of the housing of the unit and its close distance to the pole or wall has mechanical advantages but also presents a challenge in terms of cabling and access to external interfaces.

Presently, there are two approaches to cabling a RRU or antenna unit. The first is to use only external connectors but this means bigger connectors with integrated ingress protection seals which are both expensive and on products with a small footprint they are difficult/impossible to integrate into the design. The second approach is to have a maintenance cavity in the housing which allows for the use of cheaper internal connectors but requires a cover or door which is easy to access and provides a reliable ingress protection seal around the edges and cables. A current solution uses a maintenance cavity with a door that is hinged towards the rear of the unit and opens downwards. In this current solution the cables are installed from the rear (the side of the support structure) of the unit which means the maintenance cover (door) gets in way and the cables must be threaded through from the rear. The minimum distance to the support structure is defined by the cables which exit the maintenance cavity at an angle towards the support structure. Cable bending radiuses are too tight for the current cables. The mounting bracket and maintenance cover block the airflow in the lower part of the heatsink.

SUMMARY

It is an object of the disclosure to provide an improved door and suspension mechanism assembly for use with an elongated housing.

The foregoing and other objects are achieved by the features of the independent claims. Further implementation forms are apparent from the dependent claims, the description and the figures.

According to a first aspect, a door and suspension mechanism assembly are provided for use at or near an end of an elongated housing, the door and suspension mechanism assembly comprising a suspension mechanism allowing a linear movement of the door relative to the elongated housing and the mechanism allowing for a pivoting movement of the door relative to the elongated housing.

By providing a door and suspension mechanism assembly that allows the door to make a linear movement and a pivoting movement it becomes possible to provide easier access to a cavity in an elongated housing for maintenance personnel. The easier access allows the installation of cables faster and more reliable. The door and suspension mechanism assembly allows cables to run substantially straight into the elongated housing without sharp bending or tight radius. Better access to connectors in the cavity is provided, and the solution works also for cylindrical housings and the like. The door and suspension mechanism assembly also allows the door not to interfere with back side of the elongated housing, thereby allowing an area of a heatsink behind the cavity to be maximized and to thereby improve the cooling capacity for a device located inside the elongated housing.

In a first possible implementation form of the first aspect, the suspension mechanism comprises a pivot hinge and support arm having a variable length, the pivot hinge connecting the door pivotally to a first end of the support arm. Providing an arm with a variable length, it becomes possible to provide a linear movement to the door. By providing a pivot hinge at one end of the support arm it is possible to provide a pivoting movement to the door.

In a second possible implementation form of the first aspect, the support arm has at least two parts that can slide relative to one another or that can fold relative to one another. By providing at least two parts that can slide relative one another or that can fold relative to one another is possible to provide a support arm with a variable length.

In a third possible implementation form of the first aspect, the support arm has a second end that is configured to be secured to the elongated housing. By providing a second and that is configured to be secured to the elongated housing it becomes possible to secure the support arm to the elongated housing.

In a fourth possible implementation form of the first aspect, the pivot hinge is attached to the door near or at an edge of the door. Thus, the door can open without abutting with the elongated housing regardless of the cross-sectional shape of the elongated housing.

In a fifth possible implementation form of the first aspect, the suspension mechanism includes a planar linkage mechanism. Thus, a suspension mechanism is provided that has the required freedom of movement.

In a sixth possible implementation form of the first aspect, the door comprises at least a part of one or more openings that allow one or more cables to extend from the outside into the elongated housing. Thus, a passage for cables that have to extend into the elongated housing is provided.

In a seventh possible implementation form of the first aspect, the door is provided with an ingress protection seal associated with the part of one or more openings. Thus, ingress protection sealing for cables that extend into the elongated housing is provided.

In an eighth possible implementation form of the first aspect, the suspension mechanism allows the door to move between a closed position and an open position.

In a ninth possible implementation form of the first aspect, the suspension mechanism is provided with means to retain the door in the open position. Thus, it is easier for maintenance personnel to work in the cavity because the door does not get in their way.

In a tenth possible implementation form of the first aspect, the means to retain the door in the open position comprise a snap lock, a friction device and/or a bi-stable spring loaded linkage mechanism. Thus, an operator or service personnel does not need to hold the door in an open position and can have both hands free for carrying out work inside the elongated housing.

In an eleventh possible implementation form of the first aspect a resilient member causes the door to be retained in a closed position. Thus, a stable open position for the door can be provided.

In a twelfth possible implementation form of the first aspect, the door is connected to the pivot hinge via a bracket. Thus, effective means are provided for securing the door to the hinge.

According to a second aspect, an assembly comprising an elongated, preferably tubular housing, even more preferable cylindrical housing, and a door and suspension mechanism assembly according to the first aspect or any implementation forms thereof are provided, wherein the elongated housing is provided with at least a part of one or more openings that allow one or more cables to extend from the outside into the elongated housing, and wherein the one or more openings extend in the longitudinal direction of the elongated housing, preferably at or near a longitudinal end of the elongated housing.

By providing an assembly comprising an elongated housing, a door and suspension mechanism, closable access to an interior of the elongated housing can be provided in a practical and aesthetically pleasing way. The assembly provides for a front opening which in turn allows the elongated housing to be installed very close to a support structure.

In a first possible implementation form of the second aspect, the elongated housing is provided with a cavity near the longitudinal end.

In a second possible implementation form of the second aspect, the suspension mechanism allows the door to move between a closed position and an open position, with the door in the open position giving visual and physical access to the cavity from a substantially transverse direction. By providing physical and visual access from a transverse direction it is easier for maintenance personnel to work in the cavity when they are standing in front of a vertically mounted elongated housing.

In a third possible implementation form of the second aspect, the door has a shape and size that substantially corresponds to a cutout of the elongated housing at the longitudinal end of the elongated housing. By giving the door shape and size that substantially corresponds to a cutout of the elongated housing, it becomes possible to provide an arrangement that has a uniform shape, such as for example a cylinder or the like which is attractive from an aerodynamic point of view and from an aesthetic point of view.

In a fourth possible implementation form of the second aspect, the elongated housing has a substantially cylindrical outline and the door in its closed position is an integral part of the cylindrical outline. This provides for an aesthetically pleasing appearance of the housing, which is important since antenna units and RRUs are often placed in publicly visible locations. A cylindrical shape is also advantageous from an aerodynamic point of view in view of wind load on elongated housings that are mounted in exposed positions.

In a fifth possible implementation form of the second aspect, the elongated housing is provided with an abutment surface around an opening of the cavity, wherein the door is provided with a complementary abutment surface, wherein an ingress protection seal is provided with at least one of the abutment surfaces and wherein the direction of the normal of the abutment surface around the cavity has a larger component in the traverse direction than in the longitudinal direction of the elongated housing. By directing the abutment surface of the cavity in this way visual and physical access to the cavity is improved for maintenance personnel that is standing in front of a normally vertically mounted antenna unit for an RRU.

A sixth possible implementation form of the second aspect further comprises screw fasteners at a right angle to the abutment surface around the cavity. By placing the screw fasteners at right angles the clamping effect against the ingress protection seal is improved and thereby the ingress protection is improved.

In a seventh possible implementation form of the second aspect, the suspension mechanism is hidden from view when the door is in its closed position. This provides for an aesthetically more pleasing appearance of the elongated housing.

These and other aspects of the disclosure will be apparent from and the embodiment(s) described below.

BRIEF DESCRIPTION OF THE DRAWINGS

In the following detailed portion of the present disclosure, the disclosure will be explained in more detail with reference to the example embodiments shown in the drawings.

FIG. 4 is a longitudinal sectional view of the end section of FIG. 3 with the door in a partially open position, FIG. 5 is the longitudinal sectional view of FIG. 4 with the door in a completely open position.

DETAILED DESCRIPTION

Figure 1:
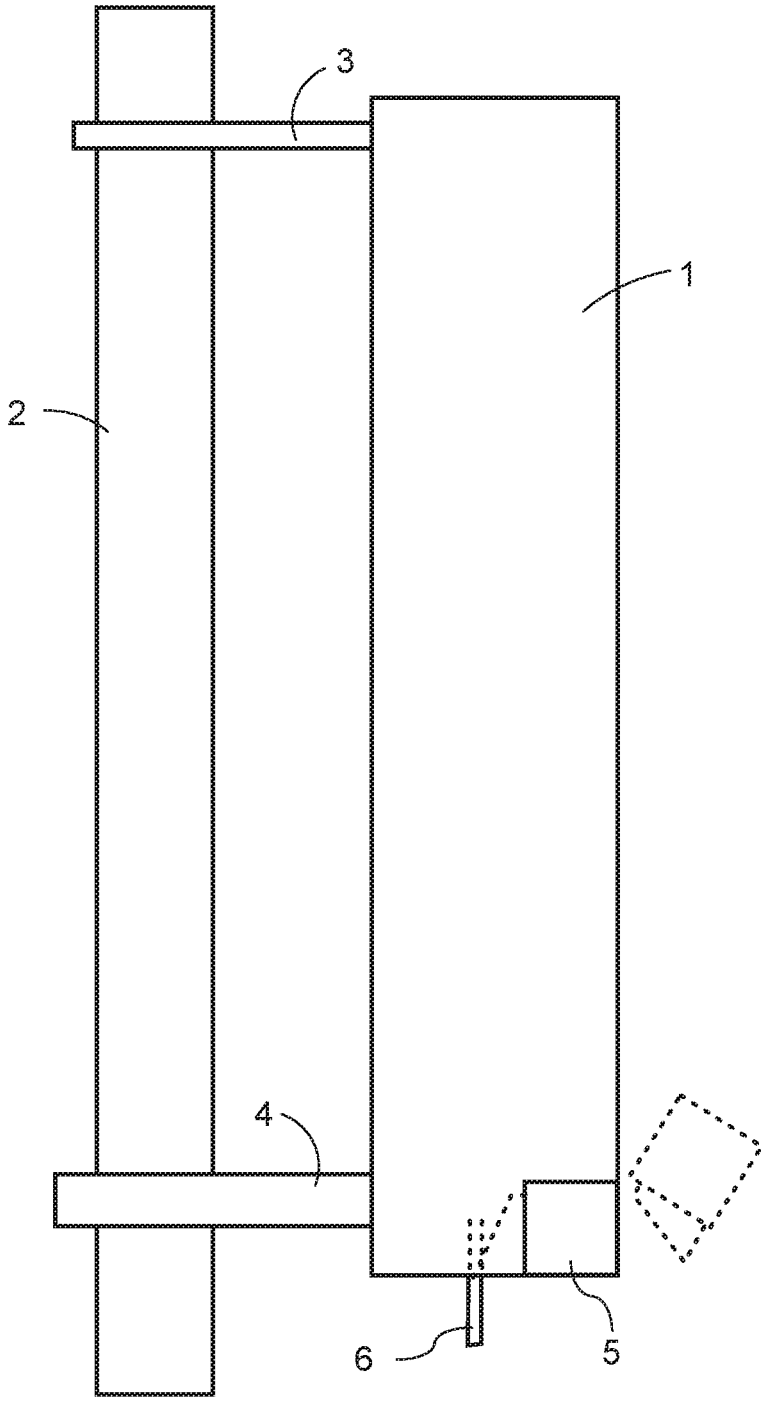
FIG. 1 is a side view of an elongated housing for an antenna unit or RRU with a door and suspension mechanism according to an example embodiment.

With reference to FIGS. 1 to 10, there is shown a door and suspension mechanism assembly for giving access to a cavity 13 (see for example FIGS. 4, 5, 6 and 11) in an elongated housing 1. FIG. 1 shows a side view of the elongated housing 1 mounted to a support structure 2 by brackets 3,4. The support structure 2 can be a (vertical) pole or a wall. The elongated housing 1 can in an example embodiment be tubular and can in an example embodiment have a circular, oval, or rectangular cross section, or a cross-sectional shape in between any of these cross-sectional shapes. The elongated housing 1 is in an example embodiment cylindrical, but not necessarily circular cylindrical.

The elongated housing 1 can be used as a housing for an antenna unit or an RRU, or for housing a combination of an antenna unit and an RRU, i.e. integrated solution. Typically, the equipment inside the elongated housing 1 needs to be cabled, i.e. one or more cables 6 extend from the outside to the interior of the elongated housing 1. These cables 6 have to be connected in situ by maintenance personal. Easy access both visually and physically to the area where the cables 6 are connected to the device or devices in the elongated housing 1, is therefore advantageous. A cavity 13 is provided at one end of the elongated housing 1, normally at the lower end for the typically vertically mounted elongated housing 1. The cavity 13 provides space for connectors (not shown) that are used to connect the equipment in the elongated housing 1 to the cables 6. Service personal needs access to this cavity 13 in order to connect the cables 6 to a connector (not shown) in the cavity 13.

Access to the cavity 13 is provided via a door 5. The door 5 is suspended from the elongated housing 1 by a suspension mechanism that in an example embodiment includes a pivot hinge 7 and a suspension arm 8 (see for example FIG. 3). The length of the suspension arm 8 is variable, i.e. the suspension arm 8 can provide a linear movement by changing the length of the suspension arm 8. At one end the suspension arm 8 is connected to the elongated housing 1 and the other free end of the suspension arm 8 is connected to the pivot hinge 7. The pivot hinge 7 also connects to the door 5, preferably via a bracket 10 (see for example FIGS. 4 and 5).

The longitudinal end of the elongated housing 1 where the door 5 is arranged is typically but not necessarily provided with vents 25 (see for example FIG. 2) for providing air to a heat sink in the elongated housing 1. The position of the vents 25 is such that the airflow is unhindered by the bracket 4 and the cables 6.

Figure 2:
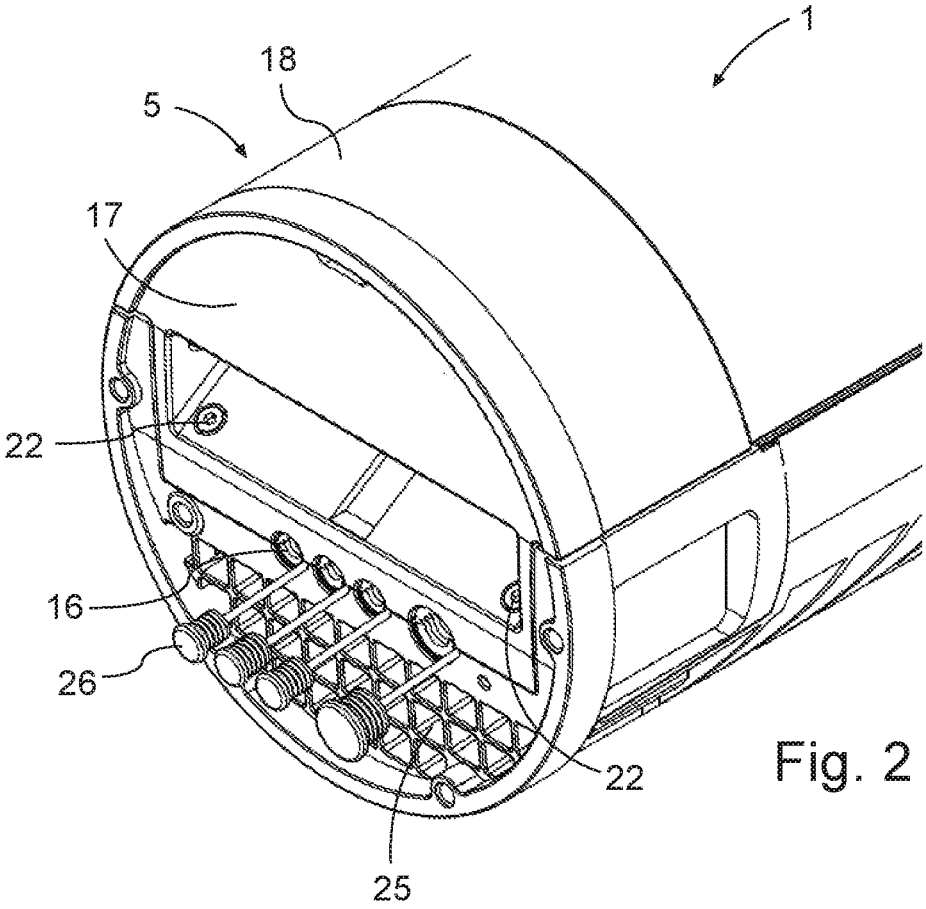
FIG. 2 is a detailed elevated view of an end section of the elongated housing of FIG. 1 with the door in the closed position.

In FIG. 2, the longitudinal end with the door 5 is shown with the door in a closed position and the door 5 secured to the housing by means of screws 22. In this embodiment, the door 5 has a curved front surface 18, but this is optional. For other embodiments, with a different cross-sectional shape of the elongated housing 1 the front surface 18 can be correspondingly differently shaped, as will be clear to those skilled in the art. For example, a rectangular cross sectional shape of the elongated housing 1 could be accompanied by a matching flat front surface 18 with opposing matching flat side surfaces and right angles to the flat front surface 18. The door 5 has also a bottom surface 17 that connects to the front surface 18. The bottom surface 17 can be substantially flat, but could also have other shapes, as required by circumstances.

In an example embodiment, the door 5 is shaped and sized as a cutout of the elongated housing 1 such that the elongated housing 1 can have a regular outline, such as for example an elongated rectangle, a cylinder or any shapes there between, when the door 5 is in its closed position. The elongated housing 1 is provided with a cutout corresponding to the shape and size of the door 5.

Figure 3:
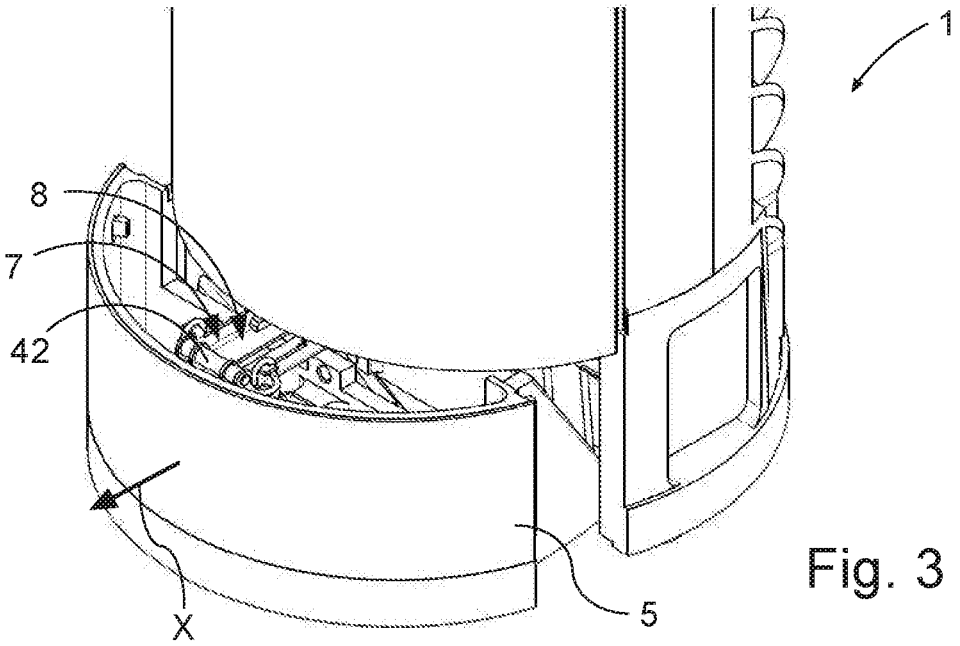
FIG. 3 is another detailed elevated view of the end section with the door in a partially open position.
Figure 6:
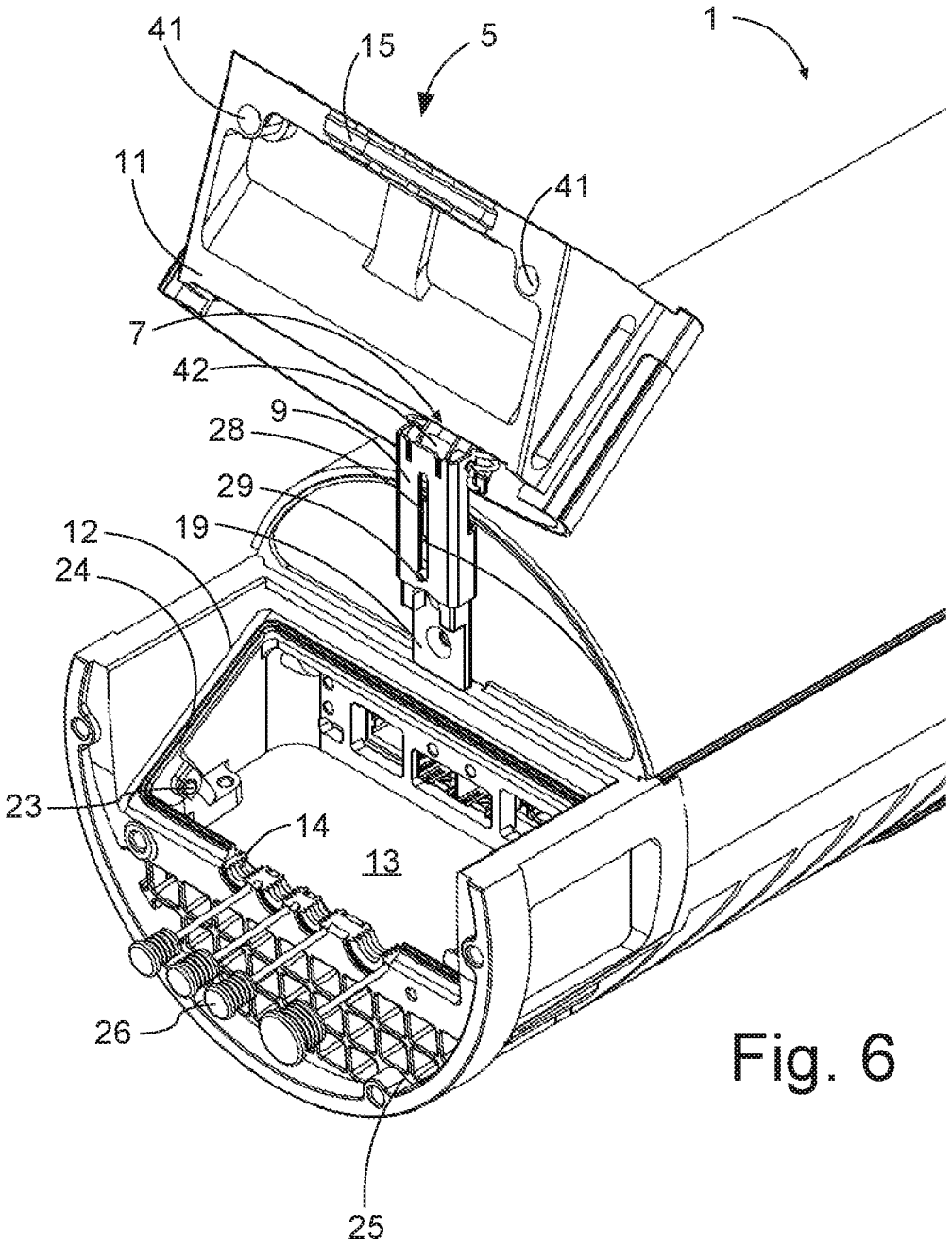
FIG. 6 is the elevated view of FIG. 2 with the door in a completely open position.
Figure 7:
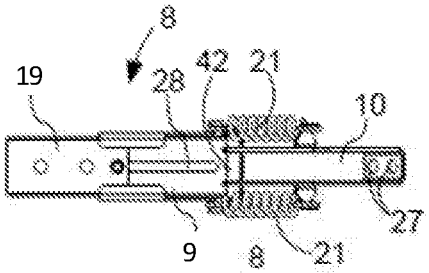
FIGS. 7, 8, 9, and 10 are isometric views of the suspension mechanism used in the previous Figs.
Figure 8:
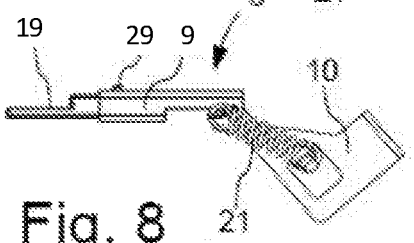
Figure 10:
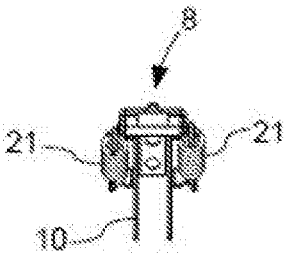
Figure 9:
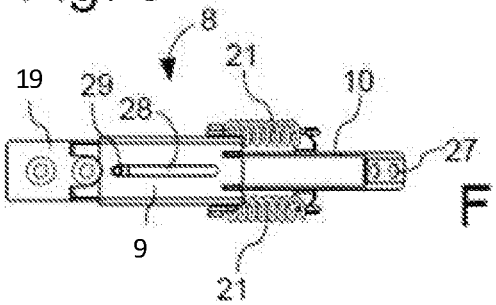

In FIG. 3 the door 5 is shown in a partially open position. From the closed position in FIG. 2 the door 5 has made a linear movement to arrive in the partially open position of FIG. 3. The linear movement is illustrated in FIGS. 3 and 4 by arrow X.

In FIG. 5 the door 5 is shown in a completely open position. The door 5 has reached this position by a linear movement provided by the suspension arm 8 followed by a pivoting movement of the door 5 about the pivot hinge 7. The linear movement and the pivotal movement may be carried out in an overlapping fashion, i.e. the movements do not meet to be strictly sequential, although the movement will preferably start with a linear movement. The pivoting movement is illustrated by the arrow Q in FIG. 5.

In order to move the door 5 from the completely open position to the closed position the operation is reversed, i.e. the door 5 is pivoted back in the direction opposite to the arrow Q and the door 5 is pushed back with a linear movement with a direction opposite to the arrow X, again in a not necessarily strictly sequential order, although the return movement will end with a linear movement.

The door 5 is provided with a part 15 of one or more openings 16 that allow one or more cables 6 to extend from the outside of the elongated housing 1 to the cavity 13 in the elongated housing 1. The openings 16 (see for example FIG. 2) are directed longitudinally from the end of the elongated housing 1 so that the cables 6 can be threaded into the elongated housing 1 straight from below. Thus, any cables 6 that are guided from the support structure 2 will not need to make any sharp bends or have any section with a tight radius on their way to the (openings 16) in elongated housing 1.

The edge of an opening around the cavity 13 in the elongated housing 1 is provided with another part 14 of the one or more openings 16. Thus, in the closed position of the door 5 the two parts 14 and 15 form a complete opening 16 allowing the cables 6 to extend from the outside of the elongated housing 1 into the cavity 13.

The door 5 is provided with an abutment surface 11 and the elongated housing 1 is provided with a corresponding abutment surface 12. The abutment surface 11 and/or the abutment surface 12 are/is provided with an ingress protection seal 24 (best seen in FIG. 6). The abutment surface 12 and the ingress protection seal 24 sealingly close an opening around the cavity 13. In the closed position of the door 5 the two abutment surfaces 11 and 12 face one another and abut one another with the ingress protection seal 24 at least partially compressed there between. The ingress protection seal 24 can be conventional ingress protection seal made of conventional ingress protection seal materials. Rubber bungs 26 provided for closing the openings 16 when no cables 6 present are a part of the ingress protection seal 24.

The abutment surface 12 with the opening giving access to the cavity 13 therein is angled such that service personnel that is facing an elongated housing 1 that is mounted to an upright support structure 2 allows direct visual and physical access from a substantially transverse direction into the cavity 13. Hereto, the component of the normal to the abutment surface 12 in the transverse direction is larger than the component in the longitudinal direction.

A part of the ingress protection seal 24 is formed by seals or gaskets that are provided in the part 14 openings 16. These seals or gaskets can be an integral part of the ingress protection seal 24 or be a separate part. The openings 16 on part 15 are provided with a separate ingress protection seal or the like to form a complete seal around the cables 6.

The door 5 is provided with bores 41 for receiving the screws 22 that are used to secure the door 5 in its closed position to the elongated housing 1. Corresponding threaded holes 23 are provided in the elongated housing 1. The threaded holes 23 (and the bores 41 when the door 5 is in its closed position) are arranged at a right angle relative to the abutment surface 12 such that the tightening force of the screws 22 is most effectively applied to the ingress protection seal 24.

The suspension mechanism that connects the door 5 to the elongated housing 1 includes the suspension arm 8 with the variable length that is in an example embodiment formed by two slider parts 9 and 19 that can slide relative to one another. Part 19 is secured to the elongated housing 1 and part 9 is connected to the pivot hinge 7. FIGS. 7 to 10 show an example embodiment of the suspension mechanism in greater detail.

In the embodiment of FIGS. 7 to 10 the suspension mechanism is provided with the suspension arm 8 that has two parts that can slide relative to one another, a first slider part 19 that is to be secured to the elongated housing 1 and a second slider part 9 that can slide relative to the second slider part 9. The first slider part 19 forms a first end of the suspension arm 8. The first slider part 19 forms a second end of the suspension arm 8 that is configured to be secured to the elongated housing 1, e.g. by a screw through a hole in the first slider part 9.

The first slider part 19 can slide relative to the second part 9 by means of guide rails (or any other suitable guide structure) that are integrated in either the second slider part 9 or the first slider part 19. The suspension arm 8 can in an embodiment (not shown) have a telescopic structure with the parts of the suspension arm 8 fitting into one another and guiding one another. In the shown embodiment the suspension arm 8 is provided with means to provide an end stop for both the retracted and extended position of the suspension arm 8 in the form of a slit 28 in the second slider part 9 and a pin 29 secured to the second slider part 9. The pin 29 is slidably received in the slit 28 and prevents the suspension arm 8 from being overextended.

The pivot hinge 7 is arranged at the free end of the first slider part 19, i.e. at or near the first end of the suspension arm 8. The pivot hinge 7 includes a pin 42. The second slider part 9 is provided with holes for receiving and retaining the pin 42.

A bracket 10 is pivotally suspended from the pin 42. The bracket 10 is provided with corresponding holes for receiving the pin 42. The bracket 10 is configured to be attached to the inner side of the door 5 such that the door 5 can pivot around the pin 42. Hereto, the bracket 10 has a shape and size that is suitable for attachment to the inner side of the door 5. Further, in the present example embodiment, the bracket 10 is provided with screw holes 27 that facilitate the attachment of the bracket 10 to the door 5 by screws (not shown) that will engage threaded bores (not shown) on the inner side of the door 5. The bracket 10 is shaped and sized such that the pivot axis of the hinge is positioned at or near an edge of the door 5.

The suspension arm 8 is provided with two helical wire springs 21 (a single spring, of any suitable type, e.g. of an elastomeric material or the like could also be used instead). One end of the helical wire springs 21 is connected to the second slider part 9 and the other end of the wire springs 21 is connected to the bracket 10. The helical wire springs 21 are mounted as a tension springs. Hereto, the second slider part 9 and the bracket 10 are provided with respective hooks. The hooks are placed such that the helical wire springs 21 extend on one side of the longitudinal axis of the pin 42 when the door 5 is in its closed position and on another side of the longitudinal axis of the pin 42 when the door 5 is in the fully open position shown in FIG. 5. This means that the helical wire springs 21 are most stretched when the door 5 assumes an intermediate position in between its closed and fully open positions. The result is a bi-stable mechanism, with the helical wire springs 21 urging the door 5 towards its closed position when the door 5 is in any position between the intermediate position and its closed position and with the helical wire springs 21 urging the door 5 towards its open position when the door 5 is in any position between the intermediate position and its fully opened position. The bi-stable mechanism causes the door 5 to assume a stable completely open position and prevents the door 5 from falling back towards the closed position, regardless of the orientation in which the elongated housing 1 is mounted to a support structure. Also the rotational position of the door 5 that corresponds to the rotational position of the closed position will be a stable position. These two stable positions facilitate the handling of the door 5 by maintenance personnel, for example by rendering it unnecessary for maintenance personnel to hold the door 5 open when working in the cavity 13.

In shown embodiment, the suspension mechanism is hidden from view when the door 5 is in its closed position.

In order to open the door service personnel will remove the screws 22, pull the door 5 away from the elongated housing 1 in a linear movement as shown by the arrow X, followed by a pivoting movement as shown by the arrow Q, the first part of the pivoting movement being against the force of the helical springs 21 with the last part of the pivoting movement being supported by the force of the helical springs 21. The door 5 is retained in the fully open position by the force of the helical springs 21 and thus service personnel has both hands free to work in the cavity 13. Due to the fact that the door 5 opens relatively wide service personnel has a good direct view into the cavity 13 when standing in front of a vertically mounted elongated housing 1. When work is finished in the cavity 13, service personnel will rotate the door 5 in the direction opposite of the arrow Q, first against the force of the helical springs 21 and then supported by the force of the helical springs 21. Next, the service personnel pushes the door 5 in the (linear) direction against the arrow X back to its fully closed position. In the last part of the closing movement, the ingress protection seal 24 around the cavity 13 and around any cables 6 seals the cavity 13. Any openings 16 that are not having a cable inserted there through a closed by means of the rubber bungs 26. Next, the service personnel tightens the screws 22 and the cavity 13 is now hermetically sealed.

Figure 11:
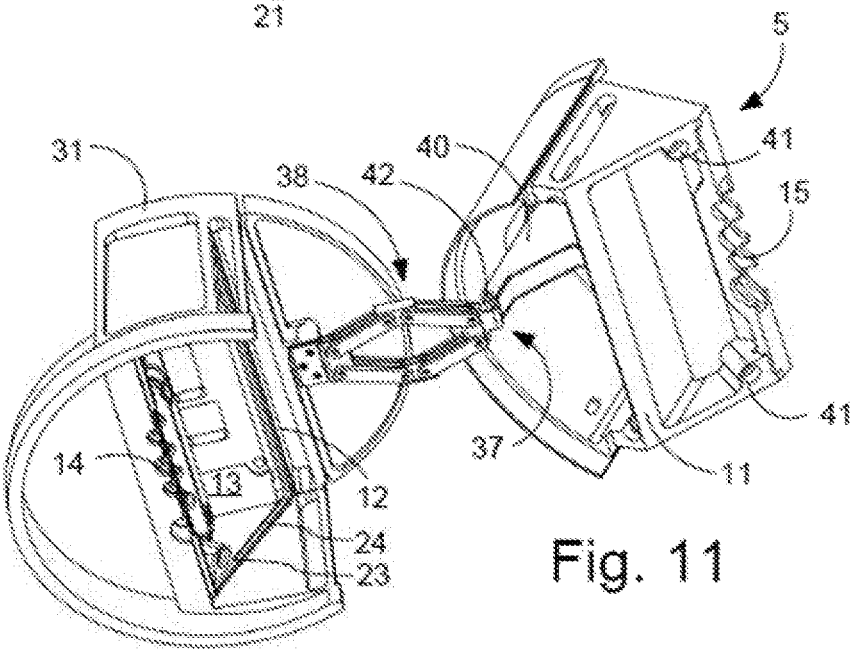
FIG. 11 is an elevated view of the end section of the previous Figs. using another example embodiment of the suspension mechanism.

FIG. 11 shows another example embodiment of the door 5 and suspension mechanism assembly. The example embodiment of FIG. 11 is essentially identical to the example embodiment described here above, except for the construction of the support arm with the variable length. In the example embodiment of FIG. 11, the support arm 38 includes a planar linkage that allows the length of the support arm to be adapted between a retracted position and an extended position (shown). The first free end of the support arm 38 is provided with a hinge 37 including a pin 42 that connects to a bracket 40 that is suited for being secured to the door 5. The second end of the support arm 38 is secured to a subframe 31 that is configured to be connected to the elongated housing 1. Various forms of planar linkage can be used for the support arm 38. The operation of the door 5 and suspension mechanism assembly shown in FIG. 11 is essentially identical to the operation of the door 5 and suspension mechanism assembly described with reference to FIGS. 1 to 10.

The suspension mechanism does not necessarily need to include a variable length arm with a hinge at an end thereof. Other suspension mechanisms that provide a combination of a linear movement and a pivoting movement can equally well be used. Such suspension mechanisms can use straight and/or curved guide rails or slits, chains, wires, gears or combinations thereof.

In an embodiment the suspension mechanism is provided with means to retain said door in said open position. The means to retain the door and the open position can use a snap lock, a friction device and/or a bi-stable spring loaded linkage mechanism.

The disclosure has been described in conjunction with various embodiments herein. However, other variations to the disclosed embodiments can be understood and effected by those skilled in the art in practicing the claimed disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. The reference signs used in the claims shall not be construed as limiting the scope.

What is claimed is:

1. A door and suspension mechanism assembly for use with an elongated housing, comprising:

a door, wherein the door comprises a first part of one or more first openings along an edge of the door, wherein the first part of the one or more first openings is configured to couple to a second part of one or more second openings on the elongated housing to form a complete opening, wherein the complete opening allows one or more cables to extend along a longitudinal axis from outside into the elongated housing, and wherein the elongated housing comprises the longitudinal axis; and a suspension mechanism aligned along a first axis, wherein the suspension mechanism allows for a linear movement of the door along the first axis relative to the longitudinal axis of the elongated housing, wherein the longitudinal axis is orthogonal to the first axis, and wherein the suspension mechanism allows for a pivoting movement of the door relative to the elongated housing.

2. The assembly of claim 1, wherein the suspension mechanism comprises a pivot hinge comprising:

a bracket coupled to the door;

a variable length suspension arm coupled to the elongated housing and the bracket; and a pin coupled to each of the bracket and the suspension arm, wherein the pin is configured to pivotally move the door in relation to the elongated housing.

3. The assembly of claim 2, wherein the suspension arm comprises at least two parts that are configured to slide relative to one another.

4. The assembly of claim 2, wherein the suspension arm comprises at least two parts that are configured to fold relative to one another.

5. The assembly of claim 2, wherein the suspension arm comprises a second end configured to be secured to the elongated housing.

6. The assembly of claim 2, wherein the pivot hinge is coupled to the door at an edge of the door.

7. The assembly of claim 2, wherein the door is connected to elongated housing via the bracket.

8. The assembly of claim 2, wherein the suspension arm comprises a first end configured to be coupled to the bracket.

9. The assembly of claim 1, wherein the suspension mechanism comprises a planar linkage mechanism.

10. The assembly of claim 1, wherein the door is provided with an ingress protection seal associated with the first part of the one or more first openings and the second part of the one or more second openings.

11. The assembly of claim 1, wherein the suspension mechanism allows the door to move between a closed position and an open position.

12. The assembly of claim 11, wherein the suspension mechanism is provided to retain the door in the open position.

13. The assembly of claim 12, wherein retaining the door in the open position comprises a snap lock.

14. The assembly of claim 12, wherein retaining the door in the open position comprises a friction device.

15. The assembly of claim 12, wherein retaining the door in the open position comprises a bi-stable spring loaded linkage mechanism.

16. The assembly of claim 1, wherein a resilient member causes the door to be retained in a closed position.

* * * * *